US008791638B2

(12) United States Patent
Huang et al.

(10) Patent No.: US 8,791,638 B2
(45) Date of Patent: Jul. 29, 2014

(54) LED LIGHTING SYSTEM

(75) Inventors: Chung-Tsai Huang, Taoyuan Hsien (TW); Shang-Jin Yan, Taoyuan Hsien (TW); Hsiang-Chen Wu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 155 days.

(21) Appl. No.: 13/592,815

(22) Filed: Aug. 23, 2012

(65) Prior Publication Data

US 2013/0057152 A1 Mar. 7, 2013

(30) Foreign Application Priority Data

Sep. 2, 2011 (TW) ..... 100131737 A

(51) Int. Cl.
*H05B 37/02* (2006.01)

(52) U.S. Cl.
USPC ..... 315/113; 315/122; 315/291

(58) Field of Classification Search
None
See application file for complete search history.

(56) References Cited

U.S. PATENT DOCUMENTS

| | | | | | |
|---|---|---|---|---|---|
| 5,483,127 | A * | 1/1996 | Widmayer et al. | ..... | 315/307 |
| 5,844,378 | A * | 12/1998 | LoCascio et al. | ..... | 315/307 |
| 6,072,710 | A * | 6/2000 | Chang | ..... | 363/132 |
| 7,038,400 | B2 * | 5/2006 | Rimmer et al. | ..... | 315/291 |
| 8,049,430 | B2 * | 11/2011 | Newman et al. | ..... | 315/224 |
| 8,339,048 | B2 * | 12/2012 | Newman et al. | ..... | 315/178 |
| 2005/0200308 | A1 * | 9/2005 | Rimmer et al. | ..... | 315/291 |
| 2007/0024211 | A1 * | 2/2007 | Rimmer et al. | ..... | 315/291 |
| 2009/0058387 | A1 * | 3/2009 | Huynh et al. | ..... | 323/282 |
| 2010/0060179 | A1 * | 3/2010 | Newman et al. | ..... | 315/219 |
| 2010/0141158 | A1 * | 6/2010 | Newman et al. | ..... | 315/182 |

* cited by examiner

*Primary Examiner* — Crystal L Hammond
(74) *Attorney, Agent, or Firm* — Kirton McConkie; Evan R. Witt

(57) ABSTRACT

Provided is a LED lighting system, including a lighting device driver having a power converter for converting an input voltage into a first DC voltage and outputting a first current having a substantially constant current value; and a LED lighting device assembly connected to the lighting device driver through two contacts. The LED lighting device assembly includes a plurality of light-emitting diode lighting devices having a plurality of lighting device connection bases and a plurality of LED units. The lighting device connection bases are connected in series with each other to allow the LED lighting devices to be connected in series with each other, and the lamp voltage is applied across the positive terminal and the negative terminal of the lighting device connection base and is generated by dividing the first DC voltage, thereby allowing the lamp currents outputted by the lighting device connection bases are substantially equal.

16 Claims, 7 Drawing Sheets

LED LIGHTING SYSTEM

FIELD OF THE INVENTION

The invention is related to a lighting system, and more particularly to a light-emitting diode (LED) lighting system consisted of a plurality of LED lighting devices having a plurality of LED modules.

BACKGROUND OF THE INVENTION

In recent years, the promotion of environmental protection has become a main issue. Nowadays, the movement aimed at the reduction of carbon emissions has been mushrooming. The electric industry is dedicated to develop green products, such as solar cells and light-emitting diodes. To the end of environment protection and energy saving, the light-emitting diodes have been widely employed in illuminating equipment.

Referring to FIG. 1, which shows the configuration and arrangement of a LED lighting system according to the prior art. As shown in FIG. 1, a plurality of LED lighting devices are placed in different locations in the house depending on user's demands. A single lighting device driver 1 is used to drive the LED lighting devices 1A-1C, thereby driving the LED lighting devices 1A-1C to illuminate for providing enough light for the house. The conventional lighting device driver 1 is implemented by a two-stage power converter, including a first stage circuit 11 and a second-stage circuit 12. The first-stage circuit 11 is an A-DC converter for converting an input voltage $V_{in}$ into a bus voltage $V_{bus}$ having a constant voltage value and outputting the bus voltage $V_{bus}$ to the second-stage circuit 12. The second-stage circuit 12 includes three DC/DC converters 121-123. The output ends of the DC/DC converters 121-123 are respectively connected to a set of lighting device connection base (131A, 131B), (132A, 132B), (133A, 133B). The lighting device connection base sets (131A, 131B), (132A, 132B), (133A, 133B) are respectively connected to an LED lighting device for respectively transmitting a lamp voltage $V_{o1}$, $V_{o2}$, $V_{o3}$ to a corresponding LED lighting device 1A-1C.

When the fitting switch 10 is turned on, the input voltage $V_{in}$ is transmitted to the input terminal of the first-stage circuit 11 through the fitting switch 10, and is converted into a bus voltage $V_{bus}$ having a constant voltage value of 52V by the first-stage circuit 11. The bus voltage $V_{bus}$ is downshifted into lamp voltages $V_{o1}$, $V_{o2}$, $V_{o3}$ respectively by the DC/DC converters 121-123. In this example, the lighting device driver 1 is configured to drive the LED lighting device with the same specification. In order to allow each LED lighting device to have the same luminance, the specifications of the DC/DC converters 121-123 must be the same to allow the lamp voltage $V_{o1}$, $V_{o2}$, $V_{o3}$ to be 50V. Also, the DC/DC converters 121-123 must respectively provide lamp currents $I_{o1}$, $I_{o2}$, $I_{o3}$ having the same current value with each other. Nonetheless, the DC/DC converters 121-123 have difference performance as the manufacturing processes of the DC/DC converters 121-123 are different and their constituent elements have tolerances. Therefore, the lamp currents $I_{o1}$, $I_{o2}$, $I_{o3}$ outputted by the DC/DC converters 121-123 are not the same.

Also, as each circuit stage has power loss, the input energy will diminish by the conversion process of the first-stage circuit 11 and the conversion process of the second-stage circuit 12. Thus, the energy transmitted to the lighting device is reduced. This will deteriorate the power efficiency and waste electric energy. More disadvantageously, the operating efficiency of the lighting device driver 1 can not be promoted.

Hence, the goal of reducing the carbon emissions can not be fulfilled. Furthermore, each DC/DC converter has a control circuit for controlling the operations of the DC/DC converter. Thus, the circuit complexity of the DC/DC converters 121-123 is high and the manufacturing cost of the DC/DC converters 121-123 is excessively high. If the number of the lighting device to be driven by the lighting device driver is not equal, for example, when the number of the lighting device to be driven by the lighting device driver is changed from three to six, the circuitry of the lighting device has to be redesigned according to the user's demands as the lighting devices can not be modularized to allow the number of the lighting device in the lighting device module to be changed. This would waste the development time and elevate the manufacturing cost.

Furthermore, the lighting device connection base sets (131A, 131B), (132A, 132B), (133A, 133B) and the contacts a-f of the lighting devices 1A-1C are provided with waterproof structures to meet the requirements of safety regulation. This can prevent the moisture from infiltrating the lighting device driver 1 and the lighting devices 1A-1C and damaging the lighting device driver 1 and the lighting devices 1A-1C accordingly. As each lighting device needs two electric wires pulled out from the lighting device driver 1 to be connected with the lighting device, multiple electric wires needs to be pulled out from the lighting device driver 1 when the lighting device driver 1 is set to drive a plurality of lighting devices. This would require a plurality of waterproof structures and complicate the wiring process. Hence, the construction process will be toughened and the cost incurred with the construction process is increased. Besides, the conventional two-stage lighting device driver 1 respectively provides a lamp voltage $V_{o1}$, $V_{o2}$, $V_{o3}$ having a lower voltage value to each lighting device 1A-1C. When the conventional two-stage lighting device driver 1 is applied to a LED lighting device with high luminance or high power, the wiring terminals and the electric wires must possess high current durability and high manufacturing cost. More disadvantageously, the lamp currents $I_{o1}$, $I_{o2}$, $I_{03}$ will be relatively high. This would deteriorate the power loss and lower the overall power efficiency.

SUMMARY OF THE INVENTION

An object of the invention is to provide a LED lighting system to solve the aforementioned problems encountered by the prior art.

To address the aforementioned problems, the invention provides a LED lighting system, including a lighting device driver having a power converter for converting an input voltage into a first DC voltage and outputting a first current having a substantially constant current value; and a light-emitting diode lighting device assembly connected to the lighting device driver through two contacts. The light-emitting diode lighting device assembly includes a plurality of light-emitting diode lighting devices having a plurality of lighting device connection bases and a plurality of light-emitting diode units, each lighting device connection base having a positive terminal and a negative terminal and is connected to a corresponding light-emitting diode unit for transmitting a lamp voltage and a lamp current to the corresponding light-emitting diode unit. The lighting device connection bases are connected in series with each other to allow the light-emitting diode lighting devices to be connected in series with each other, and the lamp voltage is applied across the positive terminal and the negative terminal of the lighting device connection base and is generated by dividing the first DC voltage, thereby allowing the lamp currents outputted by the lighting device connection bases are substantially equal.

Now the foregoing and other features and advantages of the invention will be best understood through the following descriptions with reference to the accompanying drawings, in which:

DESCRIPTION OF THE PREFERRED EMBODIMENT

Several exemplary embodiments embodying the features and advantages of the invention will be expounded in following paragraphs of descriptions. It is to be realized that the present invention is allowed to have various modification in different respects, all of which are without departing from the scope of the present invention, and the description herein and the drawings are to be taken as illustrative in nature, but not to be taken as a confinement for the invention.

Figure 1:
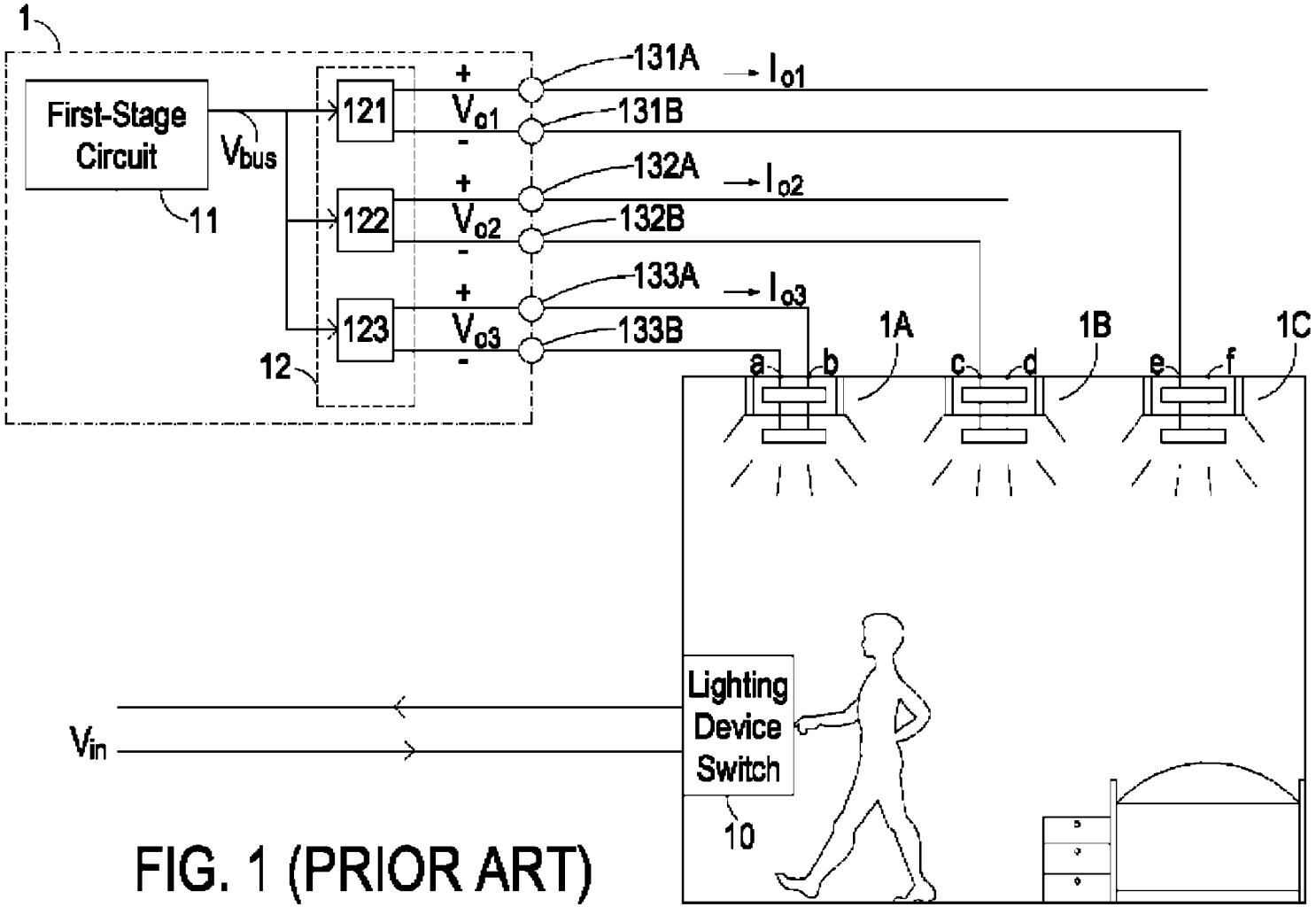
FIG. 1 (PRIOR ART)
FIG. 1 shows the configuration and arrangement of a LED lighting system according to the prior art.
Figure 2:
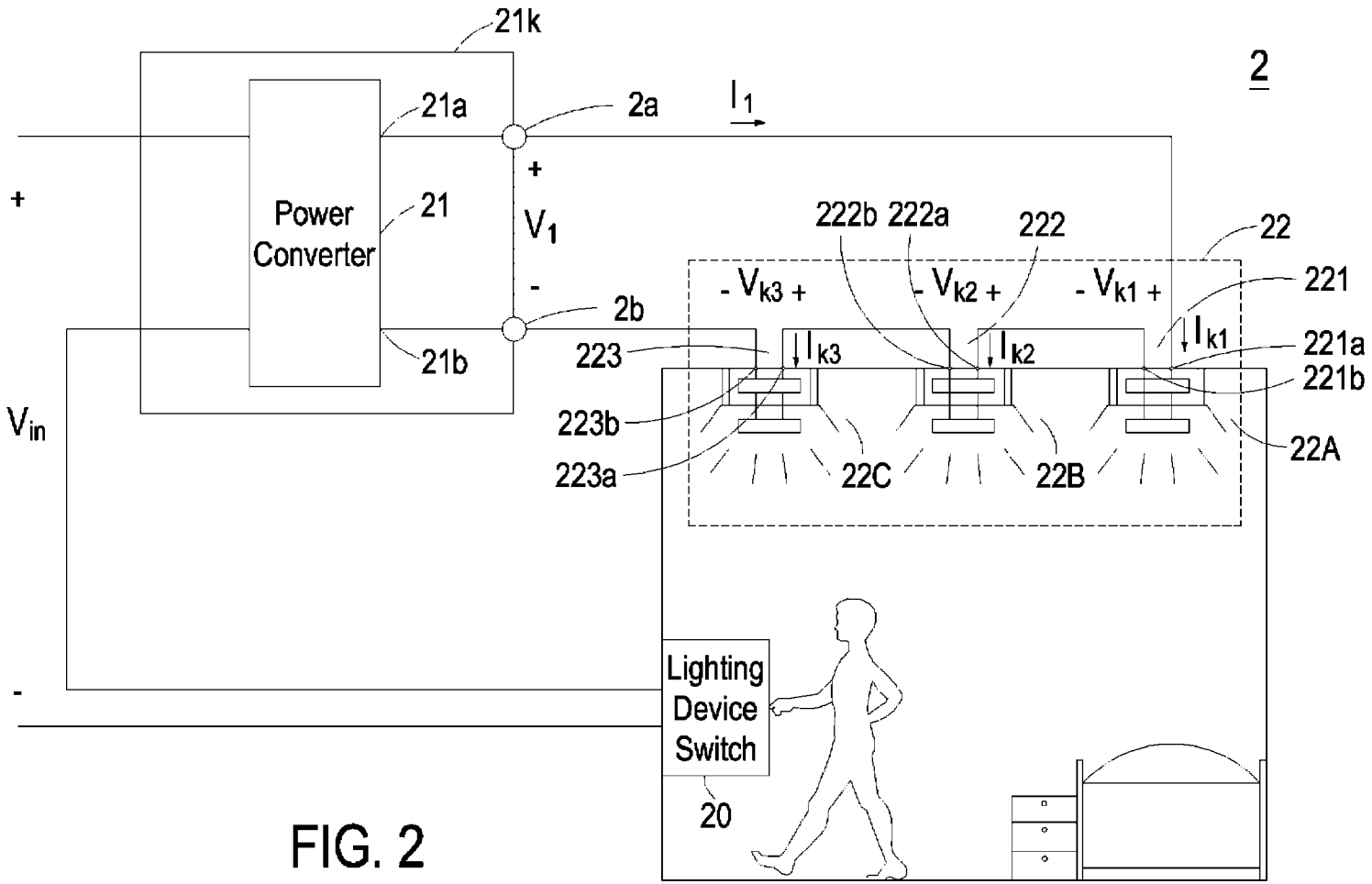
FIG. 2 shows the configuration of the LED lighting system according to a first embodiment of the invention.
Figure 3:
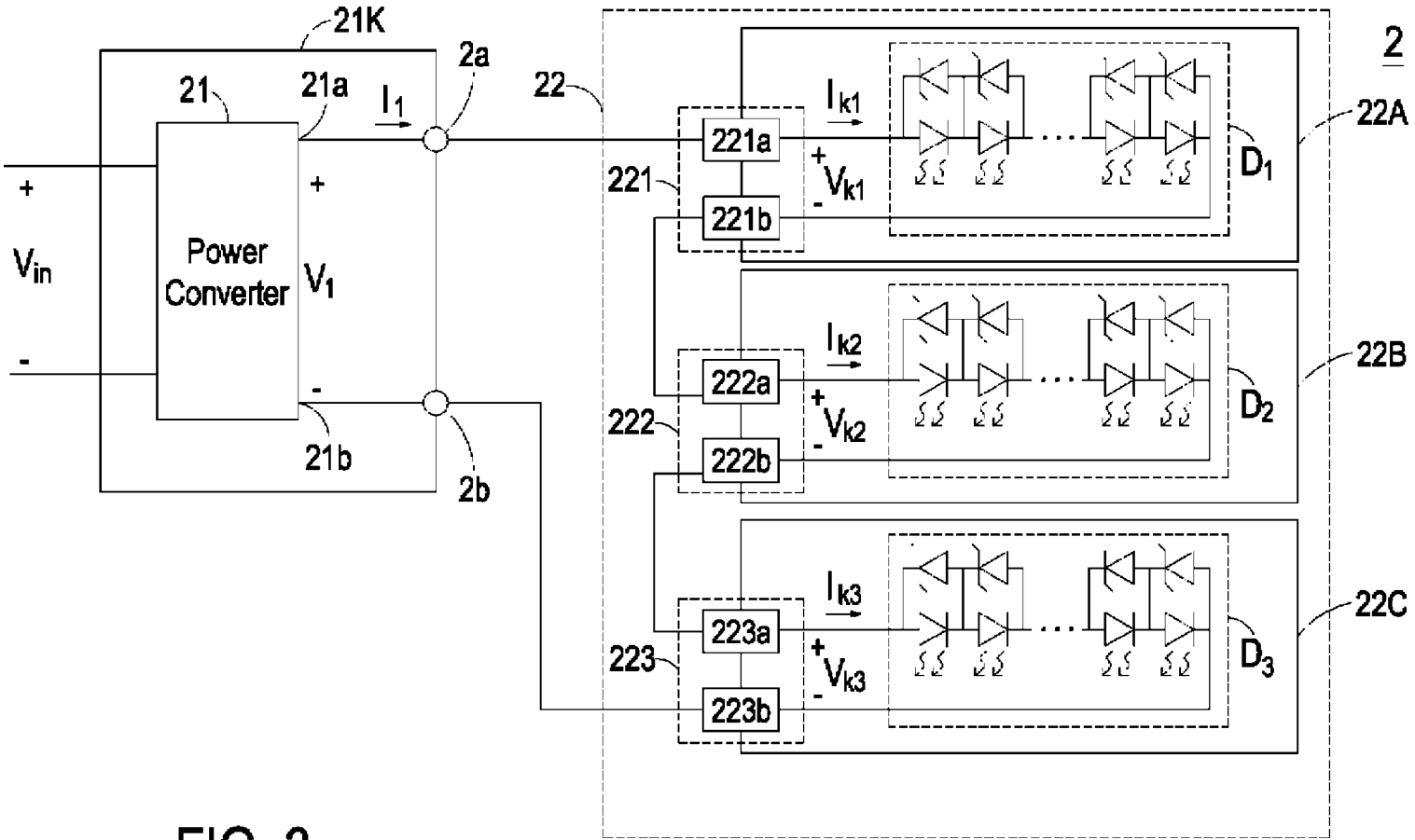
FIG. 3 shows the circuit diagram of the LED lighting system according to the first embodiment of the invention.

The inventive LED lighting system is applied to a plurality of serially-connected LED lighting devices. The number of the LED modules of the LED lighting devices, the number of the serially-connected light-emitting diode of the LED module, and the operating voltage of the LED lighting devices are flexible. Next, the inventive LED lighting system having three LED lighting devices will be described. Referring to FIGS. 2 and 3, in which FIG. 2 shows the configuration of the LED lighting system according to a first embodiment of the invention, and FIG. 3 shows the circuit diagram of the LED lighting system according to the first embodiment of the invention. The inventive LED lighting system 2 includes a lighting device driver 21K and a LED lighting device assembly 22. The lighting device driver 21K is implemented by a single-stage power converter 21 for converting an input voltage $V_{in}$ into a first DC voltage $V_1$ and outputting a first current $I_1$ having a substantially constant current value. The LED lighting device assembly 22 is connected to the lighting device driver 21K and may include three sets of LED lighting device connection bases. That is, the LED lighting devices 22A-22C respectively includes a first LED lighting device connection base set 221, a second LED lighting device connection base set 222, and a third LED lighting device connection base set 223. The positive terminal 221*a*-223*a* and the negative terminal 221*b*-223*b* of each LED lighting device connection base set are connected to the LED units D1-D3 of the corresponding LED lighting device 22A-22C. The lamp voltage and the lamp current are transmitted to the corresponding LED units D1-D3 through the LED lighting device connection base sets 221-223. The LED lighting device connection base sets 221-223 are connected in series with each other. The lamp voltages $V_{k1}$-$V_{k3}$ which are respectively applied across the positive terminals and the negative terminals of the LED lighting device connection base sets 221-223 are generated by dividing the first DC voltage $V_1$. Also, the lamp currents $I_{k1}$-$I_{k3}$ of the LED lighting device connection base sets 221-223 are substantially equal.

In this embodiment, the power converter 21 may be implemented by a single-stage circuit, which has a better power efficiency than a two-stage circuit. The power converter 21 may also be implemented by a single-stage flyback converter, an active-clamp converter, or a resonant converter for converting the input voltage $V_{in}$ into a first DC voltage $V_1$. The voltage value of the first DC voltage $V_1$ is, for example, 180V, and is higher than the input voltage $V_{in}$. Also, the power converter also outputs a first current $I_1$ having a substantially constant current value of 50 mA. The first LED lighting device connection base set 221, the second LED lighting device connection base set 222, and the third LED lighting device connection base set 223 are connected in series with each other between the first output terminal 21*a* of the power converter 21 and the second output terminal 21*b* (the first output connection terminal (waterproof contact) of the lighting device driver 21K and the second output connection terminal 2*b*) for respectively connecting to the first LED unit D1 of the first LED lighting device , the second LED unit D2 of the second LED lighting device, and the third LED unit D3 of the third LED lighting device. The first LED lighting device connection base set 221, the second LED lighting device connection base set 222, and the third LED lighting device connection base set 223 are set to transmit the lamp voltage $V_{k1}$, the lamp voltage $V_{k2}$, and the lamp voltage $V_{k3}$ to the first LED unit D1, the second LED unit D2, and the third LED unit D3, respectively.

The first LED lighting device connection base set 221 includes a positive terminal 221*a* and a negative terminal 221*b*. Likewise, the second LED lighting device connection base set 222 includes a positive terminal 222*a* and a negative terminal 222*b*, and the third LED lighting device connection base set 223 includes a positive terminal 223*a* and a negative terminal 223*b*. The positive terminal 221*a* of the first LED lighting device connection base set 221 is connected to the first output terminal (the positive terminal) of the power converter 21 through the first output connection terminal 2*a* (the positive terminal) of the lighting device driver 21K. The negative terminal of the last LED lighting device connection base set is connected to the second output terminal 21*b* (the negative terminal) of the power converter through the second output connection terminal 2*b* (the negative terminal) of the lighting device driver 21K. It is to be noted that the negative terminal of the present LED lighting device connection base set is connected to the positive terminal of the next LED lighting device connection base set. For example, the negative terminal 221*b* of the first LED lighting device connection base set 221 is connected to the positive terminal 222*a* of the second LED lighting device connection base set 222. Also, the negative terminal 222*b* of the second LED lighting device connection base set is connected to the positive terminal 223*a* of the third LED lighting device connection base set. In this manner, the lighting device driver 21K can be connected to the LED lighting device assembly 22 through only two contacts (the first output connection terminal 2*a* and the second output connection terminal 2*b*). Thus, the number of the waterproof structures used in the lighting device driver 21K is greatly reduced, thereby lowering the manufacturing cost of the LED lighting system 2 and softening the construction process of the LED lighting system 2.

In addition, the first lamp current $I_{k1}$, the second $I_{k2}$, and the third lamp current $I_{k3}$ are provided for the first LED unit D1 of the first LED lighting device 22A, the second LED unit D2 of the second LED lighting device 22B, and the third LED unit D3 of the third LED lighting device 22C through the first LED lighting device connection base set 221, the second LED lighting device connection base set 222, and the third LED lighting device connection base set 223, respectively. In this embodiment, the LED lighting system 2 is configured to drive a plurality of serially-connected LED lighting devices, and each LED unit D1-D3 of the LED lighting devices 22A-22C is implemented by at least one LED module. Also, the number of the LED modules of the LED lighting devices, the number of the serially-connected light-emitting diode of the LED module, and the operating voltage of the LED lighting devices are flexible. When the lighting device switch 20 is turned on and the input voltage $V_{in}$ is transmitted to the input end of the power converter 21, the power converter 21 converts the input voltage $V_{in}$ into a first DC voltage $V_1$ and outputs a first current $I_1$ having a substantially constant current value. As the power converter 21 is operating in a constant-current mode and the LED lighting device connection base sets 221-223 are serially connected, the lamp currents $I_{k1}$-$I_{k3}$ are all equal with the first current $I_1$. Even if the LED units D1-D3 of the LED lighting devices 22A-22C are manufactured by different manufacturers, the lamp currents $I_{k1}$-$I_{k3}$ which have the same current value with each other can balance the luminance of the light-emitting diodes in the LED units D1-D3.

In this embodiment, the first DC voltage $V_1$ is equal to the sum of lamp voltages $V_{k1}$-$V_{k3}$, and can be varied along with the lamp voltages $V_{k1}$-$V_{k3}$. As the voltage value of each lamp voltage $V_{k1}$-$V_{k3}$ can be varied along with the rated operating voltage of the connected LED lighting device, the voltage value of the first DC voltage $V_1$ can be increased along with the increase of the number of the LED lighting device connection base set and the rated operating voltage of each LED lighting device. As the first DC voltage $V_1$ outputted by the lighting device driver 21K has a larger voltage value than the voltage value (50V) outputted by conventional lighting device driver, the inventive lighting device driver can be used to drive a plurality of serially-connected LED lighting devices. In order to prevent the users from touching the LED lighting devices or the lighting device driver 21K to get electrical shock when the LED lighting devices are operating, the rated operating voltage of the conventional LED lighting device is set to be lower than the minimum voltage (60V) value promulgated by the safety regulations. Thus, the voltage values of the lamp voltages $V_{k1}$-$V_{k3}$ will not increase along with the number of the LED lighting device connection base set. Even of the users touch the LED lighting devices or the lighting device driver 21K as a result of inadvertence, the users can be protected from getting electrical shock. Also, the external contacts, such as the first output terminal 2*a*, the second output terminal 2*b*, the positive terminals 221*a*-223*a* of the LED lighting device connection base sets, and the negative terminals 221*b*-223*b* of the LED lighting device connection base sets are provided with waterproof structures, thereby preventing moisture from infiltrating into the LED lighting system 2 to cause damage or inflict electrical shock on users.

In this embodiment, the power converter 21 is implemented by a single-stage circuit in order to improve the power efficiency and reduce the power loss of the power converter 21. Also, the LED lighting device connection base sets 221-223 are serially connected. Thus, the lamp currents $I_{k1}$-$I_{k3}$ outputted to the LED lighting devices 22A-22C are substantially equal. When the LED lighting device connection base sets 221-223 are applied to LED lighting devices with the same specification, the luminance of the LED lighting devices are the same with each other.

Figure 4:
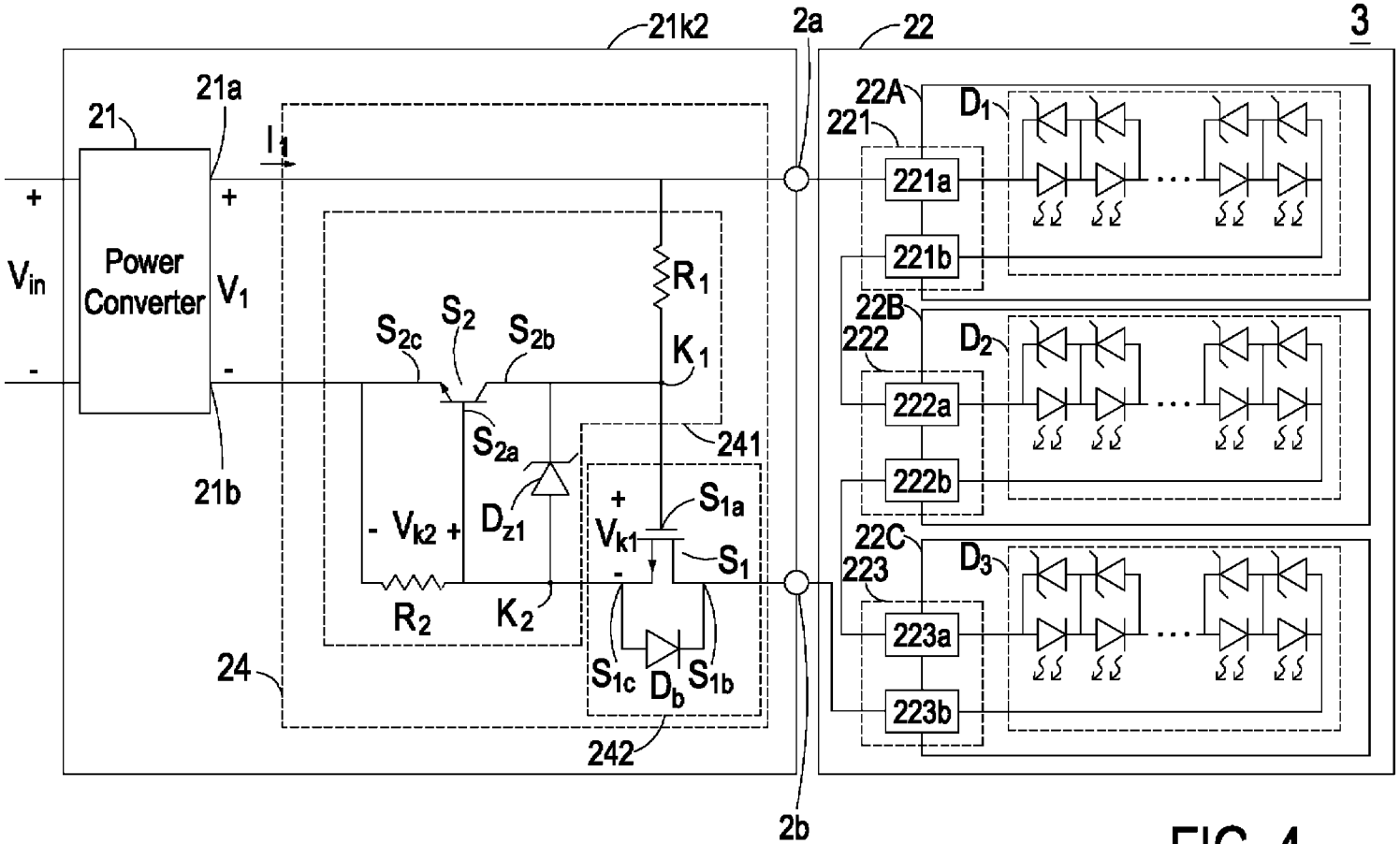
FIG. 4 shows the circuitry of the LED lighting system according to a second embodiment of the invention.

Referring to FIG. 4 and FIG. 3, in which FIG. 4 shows the circuitry of the LED lighting system according to a second embodiment of the invention. As shown in FIG. 4, the inventive LED lighting system 3 includes an over-current protection circuit 24 connected between the power converter 21 and the LED lighting device assembly 22 in addition to the power converter 21 and the LED lighting device assembly 22. That is, the over-current protection circuit 24 is connected between the power converter 21 and output connection side (2*a*, 2*b*) of the lighting device driver 21K for preventing the first current $I_1$ outputted by the power converter 21 from getting excessive. Under abnormal conditions, the first current $I_1$ will increase instantaneously. In order to prevent the excessive first current $I_1$ from feeding back to the power converter 21 and damaging the lighting device driver 21K, the over-current protection circuit 24 will be activated to break the current transmission loop of the first current $I_1$ between the power converter 21 and the lighting device connection bases 221-223 when the first current $I_1$ reaches a predetermined value. The power converter 21 and the over-current protection circuit 24 are configured as a lighting device driver 21K2. The power converter 21 and the over-current protection circuit 24 can be modularized. Thus, the lighting device driver 21K2 can be connected to the LED lighting device assembly 22 through only two contacts, thereby reducing the number of the waterproof structures used in the lighting device driver.

Referring again to FIG. 4, the over-current protection circuit 24 includes a current detector 241 and a switch circuit 242. The current detector 241 is connected to the output end of the power converter 21 and the switch circuit for generating a first control voltage $V_{k1}$ according to the first current $I_1$ flowing through the current detector 241 and outputting the first control voltage $V_{k1}$ to the control terminal of the switch circuit 242. The magnitude of the first control voltage $V_{k1}$ is used to control the ON/OFF operations of the switch circuit 242. In this embodiment, the switch circuit is connected to the current loop of the first current $I_1$, and includes a first switch element $S_1$ and a body diode $D_b$. The current detector 241 includes a first resistor $R_1$, a second resistor $R_2$, a second switch $S_2$, and a first zener diode $D_{Z1}$. In this embodiment, the first switch element $S_1$ is implemented by a MOSFET. The control terminal $S_{1a}$ and the two current terminals $S_{1b}$, $S_{1c}$ are the gate, the drain, and the source of the MOSFET, respectively. The second switch element $S_2$ is implemented by a bipolar junction transistor (BJT). The control terminal $S_{2a}$ and the two current terminals $S_{2b}$, $S_{2c}$ are the base, the collector, and the emitter of the BJT, respectively.

In the switch circuit 242, the control terminal $S_{1a}$ of the first switch element $S_1$ is connected to a first node $K_1$. The current terminal $S_{1b}$ of the first switch element $S_1$ is connected to the second output connection terminal 2*b* of the lighting device driver 21K2. The current terminal $S_1$, f the first switch element $S_1$ is connected to a second node $K_2$. The cathode of the body diode $D_b$ is connected to the current terminal $S_{1b}$ of the first switch element $S_1$. The cathode of the body diode $D_b$ is connected to the current terminal $S_{1c}$ f the first switch element $S_1$.

In the current detector 241, one end of the first resistor $R_1$ is connected to the first output terminal 21*a* of the power converter 21 and the first output connection terminal 2*a* of the lighting device driver 21K2. The other end of the first resistor $R_1$ is connected to the first node $K_1$. The cathode of the first zener diode $D_{Z1}$ is connected to the first node $K_1$, and the anode of the first zener diode $D_{Z1}$ is connected to the second node $K_2$ for clamping the first control voltage $V_{k1}$ existed between the first node $K_1$ and the second node $K_2$. The control terminal $S_{2a}$ of the second switch element $S_2$ is connected to the second node $K_2$. The current terminal $S_{2b}$ of the second switch element $S_2$ is connected to the first node $K_1$. The current terminal $S_{2c}$ of the second switch element $S_2$ is connected to the second output terminal 21*b* of the power converter 21. One end of the second resistor $R_2$ is connected to the second node $K_2$, and the other end of the second resistor $R_2$ is connected to the second output terminal 21*b* of the power converter 21. Thus, the second resistor $R_2$ is serially connected to the first switch element $S_1$ of the switch circuit 232. The first control voltage $V_{k1}$ is existed between the first node $K_1$ and the second node $K_2$. Also, the first control voltage $V_{k1}$ can be varied along with the first DC voltage $V_1$. When the first current $I_1$ flows through the second resistor $R_2$, a second control voltage $V_{k2}$ is existed between the second node $K_2$ and the second output terminal 21*b* of the power converter 21. Also, the second control voltage $V_{k2}$ can be varied along with the first current $I_1$.

When the LED lighting system 3 is operating normally, the operations of the LED lighting device connection base sets 221-223 and the operations of the LED lighting devices 22A-22C have been discussed in the foregoing embodiment, and it is not intended to give details about the operations of these elements herein. Under this condition, the current value of the first current $I_1$ is within the rated current range, and the voltage value of the first control voltage $V_{k1}$ is larger than or equal to the threshold voltage $V_{th}$ of the switch circuit 242. Thus, the first switch element $S_1$ of the switch circuit 242 is turned on, such that the first current $I_1$ flows to the LED lighting device connection base sets 221-223 through the first switch element $S_1$. The voltage drop of the second resistor $R_2$, i.e. the voltage value of the second control voltage $V_{k2}$, will be smaller than the threshold voltage $V_{tb}$ (for example, 0.6V) of the second switch element $S_2$. Thus, the second switch element $S_2$ is turned off. Under this condition, the first current $I_1$ returns to the power converter 21 through the first switch element $S_1$ of the switch circuit 242 and the second resistor $R_2$.

On the contrary, when the current value of the first current $I_1$ increases instantaneously and exceeds the rated current range of the first current $I_1$, e.g. when the first current $I_1$ exceeds the rated current range of the first current $I_1$ by 10%, the second control voltage $V_{k2}$ generated by the first current $I_1$ flowing through the second resistor $R_2$ will be larger than the threshold voltage $V_{tb}$ of the second switch element $S_2$. Under this condition, the second switch element $S_2$ is turned on to cause the voltage value of the first control voltage $V_{k1}$ to be zero or lower than the threshold voltage $V_{th}$ of the first switch element $s_1$. Under this condition, the first switch $S_1$ is turned off to prevent the excessive first current $I_1$ from flowing back to the power converter 21 and damaging the power converter 21, thereby protecting the power converter 21.

Figure 5A:
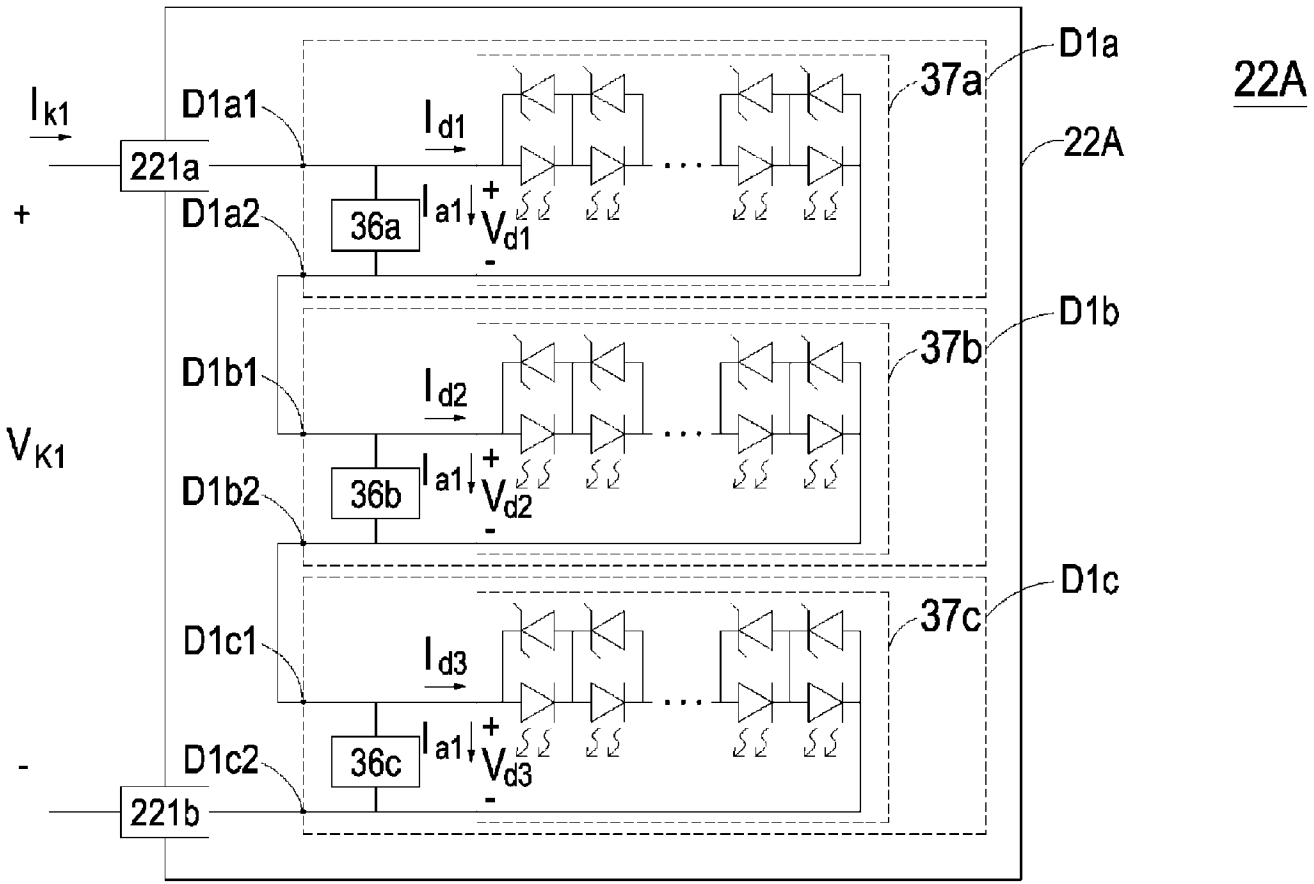
FIG. 5A shows the circuitry of the LED lighting device according to the first embodiment of the invention.
Figure 5B:
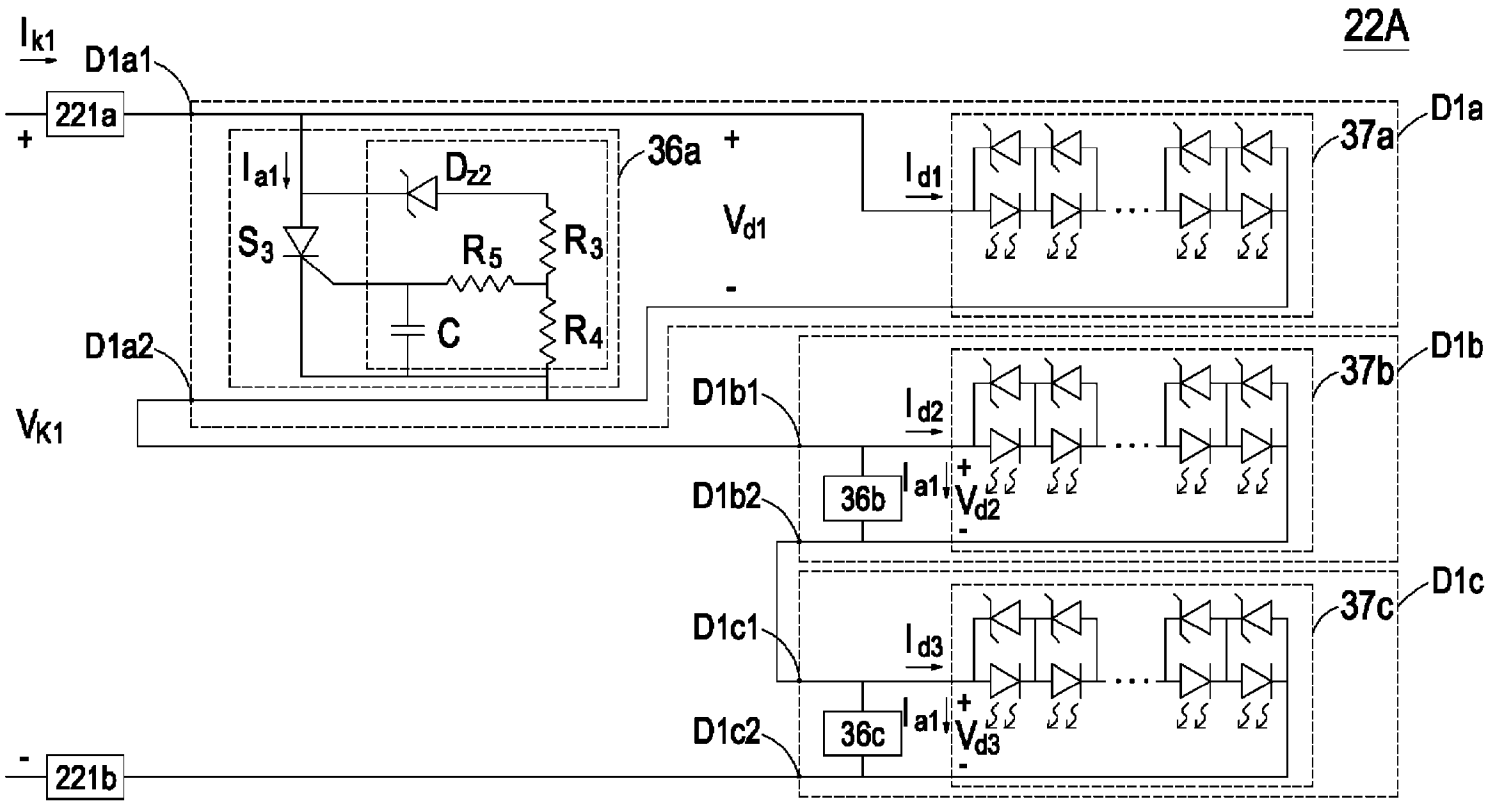
FIG. 5B partially shows a detailed view of the FIG. 5A.
Figure 5C:
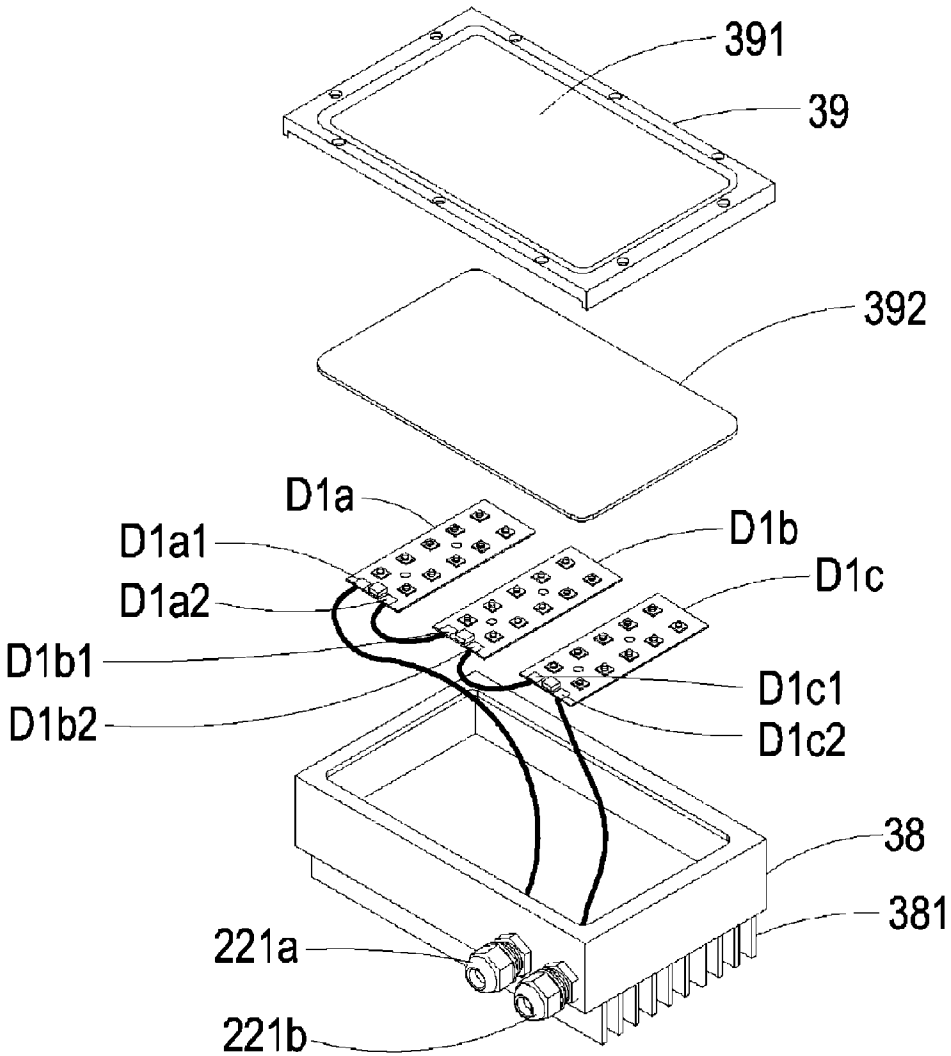
FIG. 5C shows the mechanical structure of the LED lighting device according to the first embodiment of the invention.

The LED device in the inventive LED lighting device is consisted of a single LED module or a plurality of LED modules. Next, the operating principle of the LED lighting device will be described by giving an example of a lighting device consisted of three LED modules. Referring to FIG. 3, FIG. 4, FIG. 5A, FIG. 5B, and FIG. 5C, in which FIG. 5A shows the circuitry of the LED lighting device according to the first embodiment of the invention, FIG. 5B partially shows a detailed view of the FIG. 5A, and FIG. 5C shows the mechanical structure of the LED lighting device according to the first embodiment of the invention. As shown in FIGS. 5A and 5B, the first LED unit D1 of the LED lighting device 22A includes a plurality of LED modules D1*a*-D1*c*. the positive terminal 221 and the negative terminal 221*b* of the first LED lighting device connection base set 221 for connecting the LED modules D1*a*-D1*c* are serially connected. The LED modules D1*a*-D1*c* include a plurality of output protection circuits 36*a*-36*c* and a plurality of LED arrays 37*a*-37*c*. The first output protection circuit 36*a*, the second output protection circuit 36*b*, and the third output protection circuit 36*c* are respectively connected in parallel between the first conductive terminal D1*a*1-D1*c*1 (the positive terminal) and the second conductive terminal D1*a*2-D1*c*3 of a corresponding LED module D1*a*-D1*c*. That is, one end of the first output protection circuit 36*a* is connected to the first conductive terminal Dial of the first LED module D1*a*, and the other end of the first output protection circuit 36*a* is connected to the second conductive terminal D1*a*2 of the first LED module D1*a*. The output protection circuits 36*a*-36*c* are configured to allow the users to drive a portion of the LED lighting devices 22A-22C or a portion of the LED modules D1*a*-D1*c*. When one of the LED lighting devices 22A-22C or one of the LED modules D1*a*-D1*c* is malfunctioned, the output protection circuits 36*a*-36*c* can prevent the LED lighting devices 22A-22C or the LED modules D1*a*-D1*c* from being shut down in their entirety as the LED lighting devices 22A-22C or the LED modules D1*a*-D1*c* are serially connected.

Taking the first LED lighting device 22A as an example, when the LEDs of the first LED array 37*a* of the first LED module D1*a* in the first LED lighting device 22A is malfunctioned and thus the first LED array 37*a* is abnormally open-circuited, the voltage value of the first module voltage $V_{d1}$ will increase instantaneously and exceed the first rated voltage range of the first module voltage $V_{d1}$. In this embodiment, when the first module voltage $V_{d1}$ is larger than 55V, the third switch element $S_3$ is turned on. Under this condition, the first output protection circuit 36*a* is activated to bypass the first LED module D1*a* so as to stop the first lamp current $I_{k1}$ from flowing into the first LED array 37*a*. Thus, the first lamp current $I_{k1}$ will flow through the first output protection circuit 36*a* instead. Under this condition, the first LED array 37*a* of the first LED module D1*a* stops operating, and the first lamp current $I_{k1}$ flowing through the first LED module D1*a* will not be zero by the operation of the first output protection circuit 36*a* of the first LED module D1*a*. Also, the serially-connected LED modules D1*b*-D1*c* and the LED lighting devices 22B-22C can operate normally. The current value of the first bypass current $L_1$ flowing through the first output protection circuit 36*a* equals the first lamp current $I_{k1}$ and the first current $I_1$. The current value of the first module current $I_{d1}$ flowing through the first LED array 37*a* is zero. The first bypass current $I_{a1}$ flowing into the first output protection circuit 36*a* will flow through the second conductive terminal D1*a*2 of the first LED module D1*a* to drive other LED modules D1*b*-D1*c* and the LED lighting devices 22A-22C to operate. In other words, when the LED arrays 37*a*-37*c* of the LED modules D11-D1*c* are operating normally, each module current $I_{d1}$-$I_{d3}$ will flow into a corresponding LED array 37*a*-37*c*. Under this condition, the output protection circuits 36*a*-36*c* will not operate, and the currents $I_{a1}$-$I_{a3}$ flowing into the output protection circuits 36*a*-36*c* will be zero.

Referring to FIGS. 5A and 5B, the output protection circuits 36*a*-36*c* may have the same circuit structure. next, the detailed circuitry of the first output protection circuit 36*a* will be used to illustrate its circuit structure and operating principle. The first output protection circuit 36*a* includes a third switch element $S_3$ and a triggering circuit 36*a*1. The third switch element $S_3$ is connected between the first conductive terminal D1*a*1 and the second conductive terminal D1*a*2 of the first LED module D1*a*. The triggering circuit 36*a*1 is connected to the first conductive terminal D1*a*1 and the second conductive terminal D1*a*2 of the first LED module D1*a* and the control terminal of the third switch element $S_3$ for turning on or off the third switch element $S_3$ according to the first module voltage $V_{d1}$ of the first LED module D1*a*.

In this embodiment, the third switch element $S_3$ may be a silicon-controlled rectifier (SCR). The triggering circuit 36*a*1 includes a third resistor $R_3$, a fourth resistor $R_4$, and a second zener diode $D_{Z2}$. The triggering circuit 36*a*1 may optionally include a delay circuit consisted of fifth resistor $R_5$ and a capacitor C that are connected between the second conductive terminal D1*a*2 of the first LED module D1*a* and the control terminal of the third switch element $S_3$. The second zener diode $D_{Z2}$, the third resistor $R_3$, and the fourth resistor $R_4$ are connected in series with each other between the first conductive terminal D1*a*1 and the second conductive terminal D1*a*2 of the first LED module D1*a* for the purpose of current limiting and voltage dividing. When the voltage value of the first module voltage $V_{d1}$ is increased instantaneously and exceeds the rated voltage range of the first module voltage $V_{d1}$, for example, when the voltage value of the first module voltage $V_{d1}$ is increased so as to exceed the rated voltage range of the first module voltage $V_{d1}$ by 10%, the triggering circuit 36*a*1 will transmit a triggering signal to the control terminal of the third switch element $S_3$ to turn on the third switch element $S_3$. Thus, the first output protection circuit 36*a* is activated to bypass the first LED array 37*a* of the first LED module D1*a* so as to stop the first lamp current $I_{k1}$ from flowing into the first LED array 37*a*. Thus, the first lamp current $I_{k1}$ will flow through the first output protection circuit 36*a* instead.

In this embodiment, the capacitor C is connected to the control terminal of the third switch element $S_3$. The fifth resistor $R_5$ is connected between the resistor $R_3$ and the capacitor C for generating a delay time when the triggering circuit 36*a*1 of the first output protection circuit 36*a* turns on the third switch element $S_3$. This delay time is used to increase the determining time of the triggering circuit 36*a*1, thereby reducing the possibility of the faulty operation of the first output protection circuit 36*a*.

Referring again to FIGS. 5A, 5B, and 5C. In this embodiment, the mechanical structure of the first LED lighting device 22A includes a housing 38 and a lamp cover 39. One side of the housing 38 is provided with the positive terminal 221*a* and the negative terminal 221*b* of the first LED lighting device connection base set 221 with waterproof structure. The LED modules D1*a*-D1*c* are mounted in the receiving space of the housing 38. The illuminating surfaces of the LED modules D1*a*-D1*c* face the lamp cover 39. The heat-dissipating surfaces of the LED modules D1*a*-D1*c* contact the heat-dissipating surface of the housing 38. The lamp cover 39 is linked with the opening of the housing 38. The lights generated by the LED modules D1*a*-D1*c* can penetrate the transparent portion 391 of the lamp cover 39 and reach the lighting space. In this embodiment, the mechanical structure of the first LED lighting device 22A further includes a heat-dissipating structure 381 and a light homogenizing plate 392. The heat-dissipating structure 381 is mounted on an external surface of the housing 38 for lowering the temperature of the LED modules D1*a*-D1*c*. The light homogenizing plate 392 is mounted between the LED modules D1*a*-D1*c* and the lamp cover 39 for homogenizing the lights generated by the LED lighting devices.

In conclusion, the inventive LED lighting system can drive a plurality of LED lighting devices by a lighting device driver. The inventive lighting device driver can drive LED lighting devices each having different number of serially-connected LEDs and different operating voltages. Also, the power converter used in the LED lighting system is implemented by a single-stage circuit for promoting the power efficiency. The lighting devices are connected in series with each other for balancing the currents and luminance of the lighting devices. Also, the lighting device driver can be connected to the LED lighting device assembly by only two contacts in order to reduce the number of the waterproof structures used in the LED lighting system. Thus, the construction and wiring of the LED lighting system is eased, and the cost of the LED lighting system is lowered. Besides, the inventive LED lighting system can be applied to high-luminance LED lighting devices with a lower lamp voltage and a lower lamp current, in which the lamp current can be maintained as low as 50 mA. Therefore, the wiring terminals and the electric wires used in the LED lighting system can possess low current durability and low manufacturing cost. Also, the power loss of the LED lighting system is reduced and the power efficiency of the LED lighting system is enhanced as the lamp current is lowered.

While the invention has been described in terms of what are presently considered to be the most practical and preferred embodiments, it is to be understood that the invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the invention which is defined by the appended claims.

What is claimed is:

1. A light-emitting diode lighting system, comprising:

a lighting device driver having a power converter for converting an input voltage into a first DC voltage and outputting a first current having a substantially constant current value; and a light-emitting diode lighting device assembly connected to the lighting device driver through two contacts, comprising:

a plurality of light-emitting diode lighting devices having a plurality of lighting device connection bases and a plurality of light-emitting diode units, each lighting device connection base having a positive terminal and a negative terminal and is connected to a corresponding light-emitting diode unit for transmitting a lamp voltage and a lamp current to the corresponding light-emitting diode unit;

wherein the lighting device connection bases are connected in series with each other to allow the light-emitting diode lighting devices to be connected in series with each other, and the lamp voltage is applied across the positive terminal and the negative terminal of the lighting device connection base and is generated by dividing the first DC voltage, thereby allowing the lamp currents outputted by the lighting device connection bases are substantially equal.

2. The light-emitting diode lighting system according to claim 1 wherein the power converter is a single-stage flyback converter, an active-clamp converter, or a resonant converter.

3. The light-emitting diode lighting system according to claim 1 wherein the power converter is a constant-current power converter for outputting the first current having a substantially constant current value, and the first DC voltage is the sum of the lamp voltages of the lighting device connection bases.

4. The light-emitting diode lighting system according to claim 1 further comprising an over-current protection circuit connected between the power converter and an output end of the lighting device driver for preventing the first current outputted by the power converter from being excessive.

5. The light-emitting diode lighting system according to claim 4 wherein the over-current protection circuit includes:

a switch circuit connected to a current loop of the first current;

a current detector connected to an output end of the power converter and the switch circuit for generating a first control voltage according to the first current flowing therethrough and outputting the first control voltage to a control terminal of the switch circuit, thereby driving switch circuit to turn on or off according to the first control voltage.

6. The light-emitting diode lighting system according to claim 5 wherein the switch circuit includes:

a first switch element connected to the current loop; and a body diode connected between a current terminal of the first switch element and another current terminal of the first switch element.

7. The light-emitting diode lighting system according to claim 6 wherein the current detector includes:

a first resistor having one end connected to a first output terminal of the power converter and the other end connected to a first node connecting to the switch circuit;

a second resistor connected in series with the switch circuit for generating a second control voltage when the first current flows therethrough;

a second switch element having a control terminal connected to a second node, a first current terminal connected to the first node, and a second current terminal connected to a second output terminal of the power converter; and a first zener diode connected between the first node and the second node for clamping the first control voltage generated between the first node and the second node.

8. The light-emitting diode lighting system according to claim 1 wherein a positive terminal of a first light-emitting diode lighting device connection base set of the lighting device connection bases is connected to a first output terminal of the lighting device driver, and a negative terminal of a last light-emitting diode lighting device connection base set of the lighting device connection bases is connected to a second output terminal of the lighting device driver, such that the a negative terminal of the present light-emitting diode lighting device connection base set of the lighting device connection bases is connected to a positive terminal of the next light-emitting diode lighting device connection base set of the lighting device connection bases.

9. The light-emitting diode lighting system according to claim 1 wherein each light-emitting diode device includes one light-emitting diode module or a plurality of light-emitting modules connected in series between a positive terminal and a negative terminal of a corresponding lighting device connection base.

10. The light-emitting diode lighting system according to claim 9 wherein each light-emitting diode module further includes an output protection circuit connected in parallel between a first conductive terminal and a second conductive terminal of the light-emitting diode module for bypassing the light-emitting diode module when the light-emitting diode module is malfunctioned.

11. The light-emitting diode lighting system according to claim 10 wherein the output protection circuit includes:

a third switch element connected between the first conductive terminal and the second conductive terminal of the light-emitting diode module; and a triggering circuit connected to the first conductive terminal and the second conductive terminal of the light-emitting diode module and a control terminal of the third switch element for controlling switching operations of the third switch element according to a module voltage of the light-emitting diode module;

wherein when the module voltage of the light-emitting diode module exceeds a rated voltage range of the module voltage, the triggering circuit sends a triggering signal to a control terminal of the third switch element to drive the third switch element to turn on, thereby allowing the output protection circuit to activate to bypass the light-emitting diode module.

12. The light-emitting diode lighting system according to claim 11 wherein the triggering circuit includes a third resistor, a fourth resistor, and a second zener diode connected in series between the first conductive terminal and the second conductive terminal of the light-emitting diode module for performing a current limiting function and a voltage dividing function.

13. The light-emitting diode lighting system according to claim 12 wherein the triggering circuit further includes a delay circuit comprising a fifth resistor and a capacitor.

14. The light-emitting diode lighting system according to claim 9 wherein each light-emitting diode lighting device includes a mechanical structure, comprising:

a housing having a receiving space for mounting a light-emitting diode module or a plurality of light-emitting diode modules and having one side for mounting the positive terminal and the negative terminal of the light-emitting diode connection base set with a waterproof structure; and a lamp cover linked with an opening of the housing, wherein lights generated by the light-emitting diode module or the light-emitting diode modules penetrates a transparent portion of the lamp cover to reach a lighting space.

15. The light-emitting diode lighting system according to claim 14 wherein the mechanical structure of the light-emitting diode lighting device further includes:

a heat-dissipating structure mounted on an external surface of the housing for lowering a temperature of the light-emitting diode module or the light-emitting diode modules; and a light homogenizing plate mounted between the opening of the housing and the lamp cover for homogenizing lights generated by the light-emitting diode lighting device.

16. The light-emitting diode lighting system according to claim 1 wherein a rated operating voltage value of the lighting device connection bases is lower than a minimum voltage value for allowing a human body to conduct electricity.

* * * * *